US010478657B1

(12) United States Patent
Demo

(10) Patent No.: US 10,478,657 B1
(45) Date of Patent: Nov. 19, 2019

(54) WEIGHT LIFTING PLATE

(71) Applicant: Matthew Demo, Swarthmore, PA (US)

(72) Inventor: Matthew Demo, Swarthmore, PA (US)

( * ) Notice: Subject to any disclaimer, the term of this patent is extended or adjusted under 35 U.S.C. 154(b) by 0 days.

(21) Appl. No.: 16/378,474

(22) Filed: Apr. 8, 2019

(51) Int. Cl.
*A63B 21/072* (2006.01)
*A63B 21/00* (2006.01)

(52) U.S. Cl.
CPC ..... *A63B 21/0722* (2015.10); *A63B 21/0004* (2013.01); *A63B 21/0728* (2013.01); *A63B 21/4035* (2015.10)

(58) Field of Classification Search
CPC ..... A63B 21/06; A63B 21/072–075
USPC ..... D21/680–681
See application file for complete search history.

(56) References Cited

U.S. PATENT DOCUMENTS 5,607,379 A * 3/1997 Scott ..... A63B 21/0724 482/107
2014/0024504 A1* 1/2014 Potts ..... A63B 21/4035 482/106
2014/0274596 A1* 9/2014 Krull ..... A63B 21/0724 482/107
2015/0231441 A1* 8/2015 Davies, III ..... A63B 21/15 482/107

OTHER PUBLICATIONS

Shildmyer, Adam. "Bro Shoulders: The Importance of Upper-Back and Shoulder Mobility." Volt Blog, Volt Blog, Jun. 9, 2015, blog.voltathletics.com/home/2015/6/9/bro-shoulders.*

* cited by examiner

*Primary Examiner* — Jennifer M Deichl
(74) *Attorney, Agent, or Firm* — Kevin Keener; Keener and Associates P.C.

(57) ABSTRACT

A novel weight lifting plate is disclosed. The novel weight lifting plate has a large shaped central aperture. The central aperture is shaped to receive the hand of a user. The central aperture has a plurality of ball bearings extending into the central aperture. There are four lateral ball bearings which hold a barbell in the center of the central aperture when the plate is mounted on the barbell. The plate also has two central ball bearings. The central ball bearings are disposed in recesses with springs within the recesses. When the plate is placed on the barbell the barbell pushes the central ball bearings into the recesses. When the user desires to use the plate by hand, the user places their hand in the central aperture with the ball bearings disposed between the user's fingers.

20 Claims, 6 Drawing Sheets

WEIGHT LIFTING PLATE

FIELD OF THE INVENTION

The invention pertains generally to weights for weight lifting and more specifically to a weight lifting plate designed for lifting by hand when not utilized on a weight lifting bar.

BACKGROUND OF INVENTION

Weight lifting plates are known. Weight lifting plates come in a variety of sizes and weights. The majority of weight lifting plates are circular metal plates with a small circular central aperture. The circular central aperture is configured to receive a bar. Users may place multiple weight lifting plates of various weights on a bar and do physical exercises. A user can perform a variety of exercises with the weight plates on the bar, such as squats, jerks, bench press, and arm curls.

If users want to perform isolated strength building exercises they can use a dumbbell weight. Users can do arm curls and other upper body exercises with a dumbbell. At times a user may desire to do these isolated upper body exercises with a weight lifting plate. These isolated exercises can only be performed in a limiting manner with standard weight lifting plates. When using standard weight lifting plates a user can hold on to the external edges of the plate to do the exercises. This requires the use of two hands. Some weight lifting plates have shaped apertures along the outer edges of the plate which allows the user to hold on to the plate with one hand. These shaped apertures are normally in addition to center apertures for mounting the weight lifting plate on a barbell.

These standard weight lifting plates are limited. Users may desire to use a weight lifting plate for isolated exercises but only want to use one hand. Also, if using two hands the user risks dropping the weight because of limited gripping ability. If the weight lifting plate has a shaped aperture along the edge, the plate may not be ideal for utilizing as the center of gravity of the plate is out of alignment with the user's motion. What is needed is a combination weight lifting plate having a shaped aperture in the central position of the plate which allows plate to be positioned on both a barbell and be gripped comfortably by a user.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed to a weight lifting plate comprising a body having a first side and a second side; a shaped central aperture disposed in the body, the shaped central aperture having a length and a width; one or more ball bearings disposed in the body and extending at least partially into the central aperture; and wherein the center of gravity of the weight lifting plate is disposed within the central aperture. The one or more ball bearings may further comprise one or more central ball bearings disposed in a position of alignment with a diameter of the plate; and one or more lateral ball bearings disposed out of alignment with the diameter of the plate. The weight lifting plate may further comprise one or more recesses extending from the shaped central aperture. There may be one or more springs respectively disposed in the one or more recesses.

In one embodiment of the invention the one or more recesses comprise a first recess and a second recess; the one or more springs comprise a first spring and a second spring; the one or more ball bearings comprise a first central ball bearing, a second central ball bearing, a first lateral ball bearing, a second lateral ball bearing, a third lateral ball bearing, and a fourth lateral ball bearing; the first central ball bearing and the second central ball bearing are disposed in a position of alignment with a diameter of the plate; the first lateral ball bearing, the second lateral ball bearing, the third lateral ball bearing, and the fourth lateral ball bearing are disposed out of alignment with the diameter of the plate; the first spring is disposed in the first recess; the first central ball bearing is disposed in the first recess between the first spring and the shaped aperture; the second spring is disposed in the second recess; the second central ball bearing is disposed in the second recess between the second spring and the shaped aperture; the first recess and the second recess are disposed on opposite sides of the shaped aperture; the first lateral ball bearing and the second lateral ball bearing are disposed adjacent to the first central bearing, the first lateral ball bearing and the second lateral ball bearing being equidistant from the first lateral ball bearing; and the third lateral ball bearing and the fourth lateral ball bearing are disposed adjacent to the second central bearing, the third lateral ball bearing and the fourth lateral ball bearing being equidistant from the second lateral ball bearing.

The weight lifting plate may further comprise one or more platforms disposed on an outer portion of the plate. There may be a first platform, a second platform, a third platform, and a fourth platform; the first platform and the second platform are disposed along the length of the shaped aperture on the first side of the body; the third platform and the fourth platform are disposed along the length of the shaped aperture on the second side of the body; the first platform and the second platform are disposed on opposite sides of the shaped aperture; and the third platform and the fourth platform are disposed on opposite sides of the shaped aperture.

The weight lifting plate may further comprise one or more lateral protrusions. There may be a first lateral protrusion, a second lateral protrusion, a third lateral protrusion, and a fourth lateral protrusion; the first lateral protrusion and the second lateral protrusion are disposed along the width of the shaped aperture on the first side of the body; the third lateral protrusion and the fourth lateral protrusion are disposed along the width of the shaped aperture on the second side of the body; the first lateral protrusion and the second lateral protrusion are disposed on opposite sides of the shaped aperture; and the third lateral protrusion and the fourth lateral protrusion are disposed on opposite sides of the shaped aperture.

The weight lifting plate may further comprise one or more apertures disposed in an outer portion of the plate. The weight lifting plate may further comprise a cap disposed within the shaped aperture, wherein the cap is disposed adjacent to the one or more ball bearings, wherein the cap retains the one or more ball bearings in the body. The weight lifting plate may further comprise an outer rim disposed along a circumference of the body.

The invention is also directed toward a method of exercising comprising obtaining a weight lifting plate, wherein the weight lifting plate comprises a body having a first side and a second side; a shaped central aperture disposed in the body, the shaped central aperture having a length and a width; one or more ball bearings disposed in the body and extending at least partially into the central aperture; wherein a center of gravity of the weight lifting plate is disposed within the central aperture; placing one or more fingers through the shaped central aperture; ensuring that at least one of the one or more fingers is disposed adjacent to one of the one or more ball bearings; and moving the weight lifting plate. In another embodiment the method of exercising further comprises placing a thumb against a lateral protrusion on the plate; and placing a palm against a platform on the plate.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Referring generally to FIGS. 1-6, a novel weight lifting plate 100 is disclosed. The plate 100 is composed of metal or metal alloy. Any type of metal may be utilized for the plate 100 such as steel or iron. The plate 100 may be a single piece of metal which is drop forged or may be composed of multiple pieces which are welded together or bound together with metal fasteners such as screws or bolts. The plate 100 has an outer rim 102. The outer rim 102 is a section of the plate 100 which has a maximum amount of thickness to present a lip for the user to easily grip the plate by the outer edge. Adjacent to the outer rim 102 is an outer portion 104. The outer portion 104 may have any thickness. In the preferred embodiment the outer portion 104 has less thickness than the outer rim 102 to create a lip for gripping the plate 100.

Figure 1:
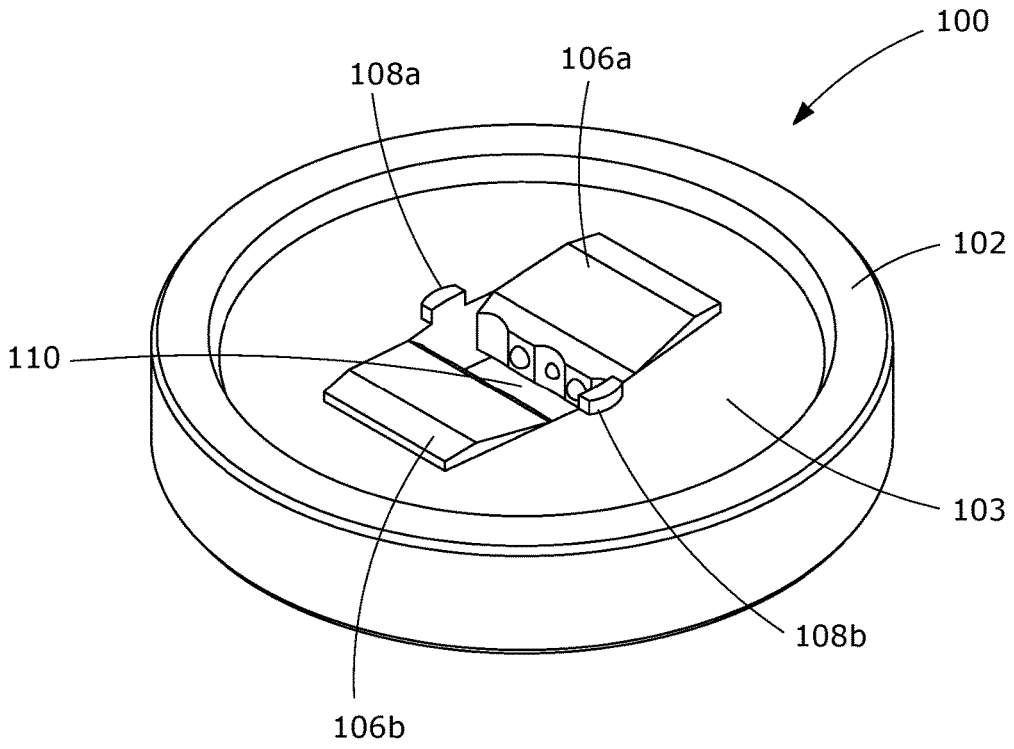
FIG. 1 is a top perspective view of the weight lifting plate.
Figure 2:
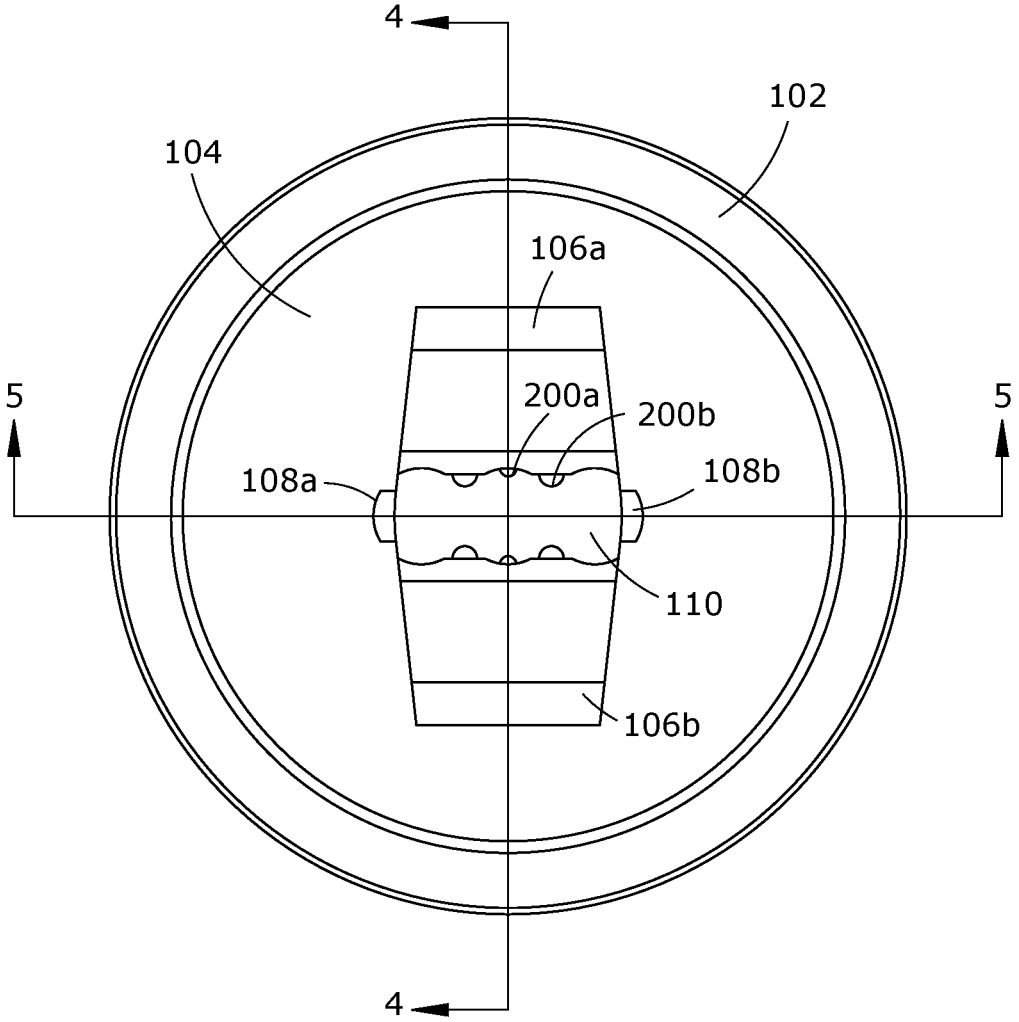
FIG. 2 is a top plan view thereof.

On the outer portion 104 are a pair of shaped platforms 106*a*, 106*b*. The platforms 106*a*, 106*b* may be any size and shape. The platforms 106*a*, 106*b* are raised portions of the outer portion 104 that present a surface to engage the palm of a user while in use. In the preferred embodiment, the platforms 106*a*, 106*b* are wedge shaped with a higher end disposed toward the outer rim 102 and a lower end disposed toward the shaped aperture 110. In the preferred embodiment the higher end has a peak with a portion of the platform 106 sloped downward toward the outer rim 102 and a portion of the platform 106 sloped downward toward the shaped aperture 110. In the preferred embodiment the platforms 106*a*, 106*b* are trapezoidal in shape when viewed directly from the top, as is shown in FIG. 2. When in this shape the width of the platforms 106*a*, 106*b* are widest adjacent to the shaped aperture 110. The width of the platforms 106*a*, 106*b* is narrowest at the ends disposed closest to the outer rim 102.

In the preferred embodiment of the invention the outer portion 104 is a flat and smooth planar surface. In other embodiments of the invention the outer portion 104 may have indentations or protrusions. The indentations may be in any number, size and shape—such as rings, words, numbers, squares, triangles, or any other shape. The protrusions may be in any number, size and shape—such as rings, words, numbers, squares, triangles, or any other shape. In some embodiments the outer portion 104 may have one or more apertures. The apertures in the outer portion 104 may be shaped as a grip for a user to place their entire hand through to easily lift the plate 100.

At the center of the plate 100 is a shaped aperture 110. The shaped aperture 110 may be any size and shape. In the preferred embodiment, the shaped aperture 110 is generally rectangular in shape with the platforms 106*a*, 106*b* disposed along the length of the rectangle and a pair of lateral protrusions 108*a*, 108*b* disposed at respective ends of the shaped aperture 110. The lateral protrusions 108*a*, 108*b* may be any size and shape. In the preferred embodiment the lateral protrusions 108*a*, 108*b* extend upward from the plan of the outer portion 104 and have the same height as the highest point of the platforms 106*a*, 106*b*. The lateral protrusions 108*a*, 108*b* preferably have semicircular shapes with curved edges disposed away from the shaped aperture 110. The lateral protrusions 108*a*, 108*b* are positioned and shaped so that the thumb of a user can curve around the outer curved edge of a lateral protrusion 108 when the fingers of the user are placed through the shaped aperture 110. As illustrated in FIG. 2, when a user places his right hand through the shaped aperture 100, the user's thumb engages lateral protrusion 108*a* and when a user places his left hand through the shaped aperture, the user's thumb engages lateral protrusion 108*b*.

In the preferred embodiment the shaped aperture 110 has a pair of central ball bearings 200*a* and four lateral ball bearings 200*b*. The ball bearings 200*a*, 200*b* may be any size and shape and may be made out of any material. In the preferred embodiment the ball bearings 200*a*, 200*b* are metal spheres. The ball bearings 200*a*, 200*b* may all be the same size in diameter or each may be a different size. In the preferred embodiment the lateral ball bearings 200*b* are larger than the central ball bearings 200*a*. In other embodiments there may be more than four lateral ball bearings 200*b* or less than four lateral ball bearings 200*b*.

Figure 3:
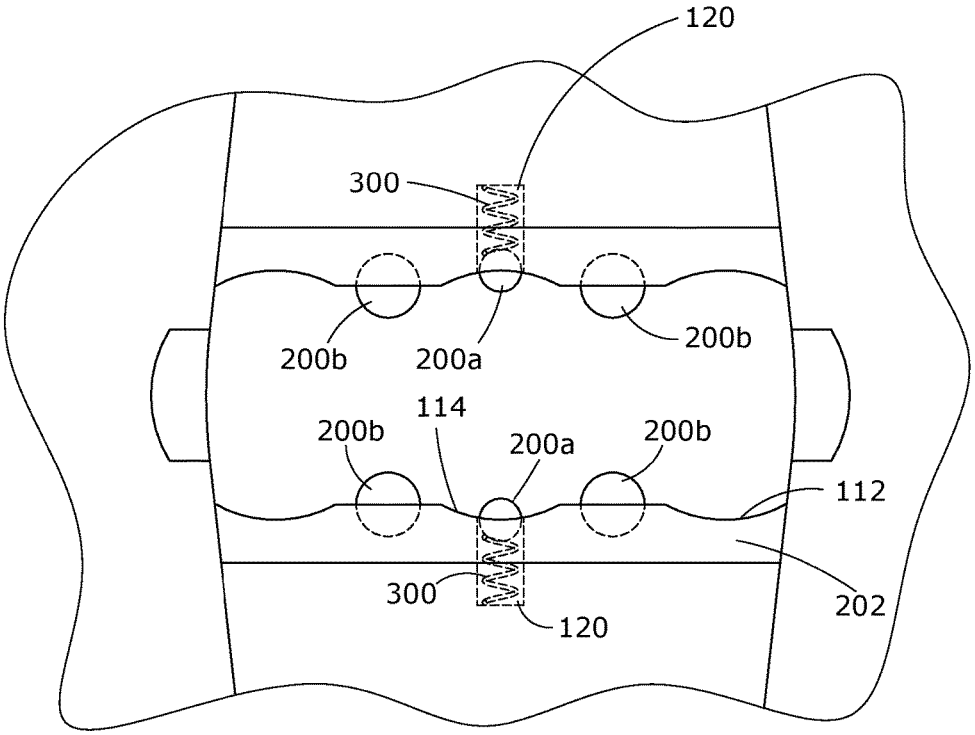
FIG. 3 is a top plan cutaway view thereof.

Referring to FIG. 3, the central ball bearings 200*a* are disposed in a recess 120. Positioned within the recess 120 is a spring 300. The spring 300 pushes the central ball bearing 200*a* outward from the recess 120 and into the shaped aperture 110. When the plate 100 is plated on a barbell, the barbell passes through the center of the shaped aperture 110 and pushes the central ball bearings 200*a* into their respective recesses 120. In this way the central ball bearings are retractable. In the preferred embodiment the lateral ball bearings 200*b* are not retractable. In this embodiment the lateral ball bearings 200*b* are each positioned in a spherical cavity which permit the lateral ball bearings 200*b* to rotate without separating from the plate 100. When a user places the plate 100 on a dumbbell bar, the bar extends through the center of the shaped aperture 110. The bar pushes the central ball bearings 200*a* into the recesses 120 and the bar presses against the plate 110. The bar also fits within all four lateral ball bearings 200*b* and is held into place by the lateral ball bearings 200*b*. In other embodiments the lateral ball bearings 200*b* are also retractable into recesses 120 with springs 300.

Referring to FIG. 3, the shape of the shaped aperture 110 is more fully illustrated. The shape of the shaped aperture 110 is shaped to permit the fingers of the user to pass comfortably through the shaped aperture 110. The shaped aperture 110 may be any size and shape but preferably is comprised of a plurality of curvilinear lines or semicircular edges. The shaped aperture 110 has an edge which defines the shape of the shaped aperture 110. The edge has an interior portion 114 which is disposed between the central ball bearing 200*a* and a lateral ball bearing 200*b*. The interior portion is a curved portion extending between the central ball bearing 200*a* and a lateral ball bearing 200*b*. The shaped aperture also has an exterior portion 112. The exterior portion 112 is a curved edge extending from a lateral ball bearing 200*b* to the end of the shaped aperture 110. The exterior portion 112 may be any size and shape. The exterior portion 112 is a curved semicircle in the preferred embodiment. The exterior portion 112 may also be curved adjacent to the lateral ball bearing 220*b* but may be directly angled and have a square edge after the curved portion so that not all of the exterior portion 112 is curved.

Figure 4:
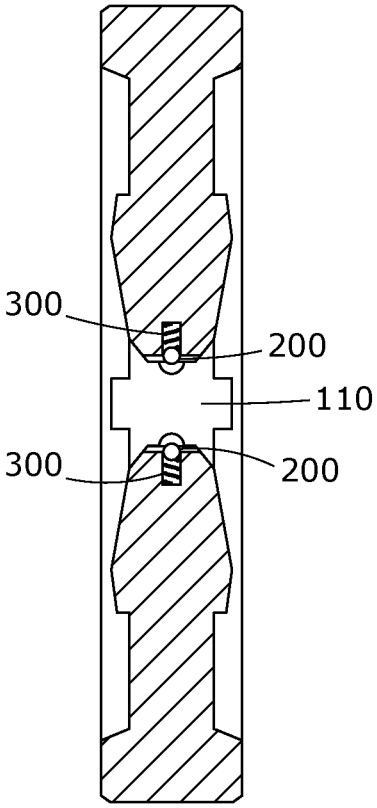
FIG. 4 is a section view taken along line 4-4.
Figure 5:
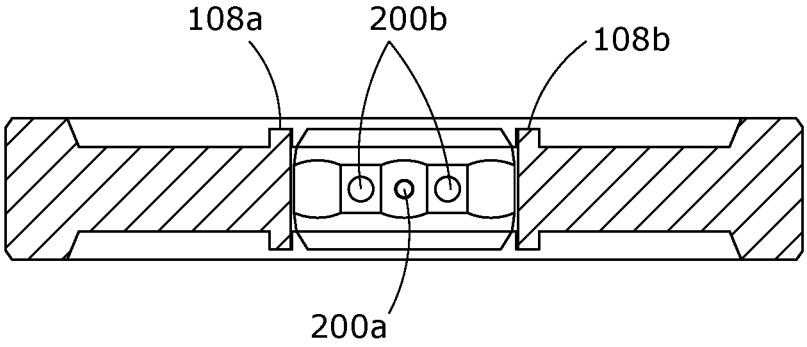
FIG. 5 is a section view taken along line 5-5.

Referring to FIG. 4 and FIG. 5, a side section views of the plate 100 are illustrated. As illustrated the ball bearing 200 is disposed in a recess 120 with a spring 300 pushing the ball bearing 200 outward. The outer end of the recess 120 may have a smaller diameter than diameter of the ball bearing 200 to prevent the ball bearing from leaving the recess 10. As shown in FIG. 4 and FIG. 5, in the preferred embodiment the plate 100 is bilateral and is mirrored on each side of a plane dissecting the plate through the middle of the plate longitudinally and perpendicularly. In this manner the plate is balanced so that the center of gravity resides within the shaped aperture 110. For instance, as shown in FIG. 4, the platforms 106*a*, 106*b* on the left side of the plate 100 are mirrored by platforms 106*a*, 106*b* on the right side of the plate 100. Furthermore, as shown in FIG. 5, the lateral protrusions 108*a*, 108*b* on the top of the plate 100 are mirrored by the lateral protrusions 108*a*, 108*b* on the bottom of the plate 100.

As shown in FIG. 3 there may be a cap 202 which is placed on the plate 100 to keep the ball bearing 200 and spring 300 disposed within the recess 120. The cap 202 may be fixed onto the plate by any number of means, such as chemical adhesive, welding, screws, bolts, microwelding, welding, or any other means. The cap 202 may be any size and shape and may extend for the entire body of the plate 100. As shown, the cap attaches to the plate 100 laterally. In another embodiment the cap 202 may fit within the shaped aperture 110 and press downward against the ball bearing 200. In this embodiment the cap 202 would have an aperture through which part of the ball bearing 200 would pass. However, regardless of configuration, the cap 202 would hold the ball bearings 200*a*, 200*b* and spring 300 in their proper respective positions. In other embodiments there is no cap 202 and the ball bearings 200*a*, 200*b* are held in place solely by friction against the recess 120 or cavities. In other embodiments the cap 202 is a continuous portion of the body of the plate 100 and not a separate piece.

When a user desires to lift the plate 100 by hand the user places his fingers through the shaped aperture 110. The user's pinky finger is placed against the exterior portion 112, the user's ring finger is placed against the interior portion 114 on the other side of the lateral ball bearing 200*b*. The user's middle finger is placed against the interior portion 114 on the other side of the central ball bearing 200*a*. The user's index finger is placed against the exterior portion 112 on the other side of the lateral ball bearing 200*b*. In this way the ball bearings 200 are disposed between the user's fingers. The user then place his thumb around the lateral protrusion 108.

Figure 6:
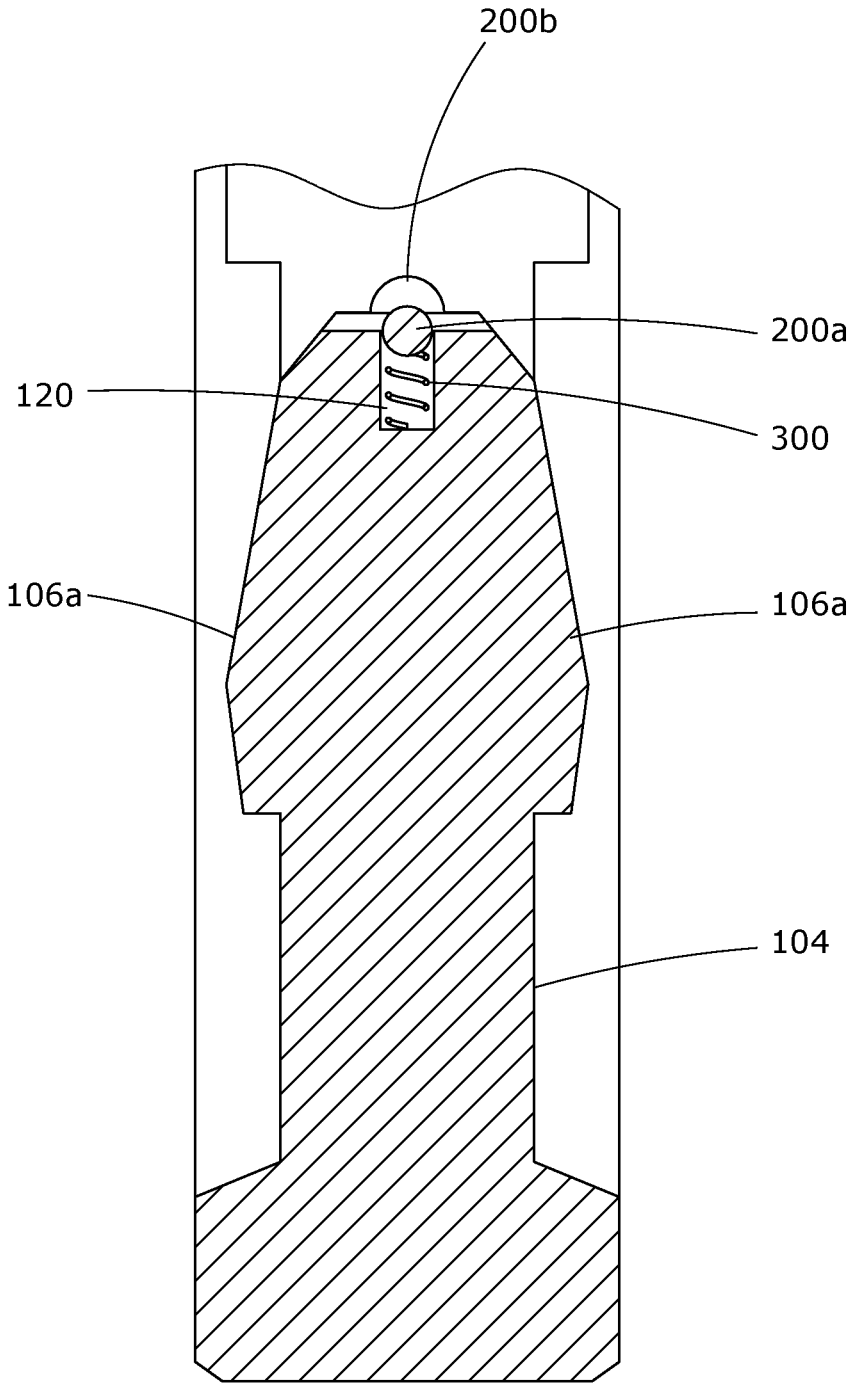
FIG. 6 is an enhanced cut away side view.

In this manner the shaped aperture 110, together with ball bearings 200, presents an ergonomic handle for the user to grip while lifting the plate 100 with one hand. The shaped aperture 110, from one side of the plate 100 to the other, is preferably rounded as is shown in FIG. 6. The rounded edge presents a comfortable edge for the user to grip the plate 100. The rounded edge may be a continuous smooth surface or may be a series of flat surfaces at angles together.

The user can perform any number of movements with the plate 100. The user can perform bicep curls, shoulder shrugs, squats, toe raises, lunges, or any other exercise movement performed utilizing free weights.

The plate 100 may come in a variety of configurations without departing from the scope of the invention. For instance the plate 100 may not have an outer rim 102. Likewise the plate 100 may not have a platform 106 or a lateral protrusion 108. In this configuration the plate 100 is completely smooth. In other configurations the shaped aperture 110 may be replaced with multiple apertures through which the user may place his fingers.

For instance, there may be a series of shaped cavities or apertures for the user to place his fingers in—similar to a bowling ball. There may also be any number of apertures or cavities so that users may adjust the position of their fingers if desired. In other embodiments the plate 100 may have a rubber sleeve or covering along the edge of the shaped aperture 110. The rubber sleeve may extend along any portion of the shaped aperture 110. The rubber sleeve may be made of any material that is softer than metal to allow the user to grip the plate 100 comfortably. The sleeve may be made of rubber, synthetic rubber, leather, sponge, or any other material. The sleeve may cover only a portion of the plate 100 or may completely encase the plate 100. Alternatively, the inner portion 108 of the plate 100 may be made of a hardened thermoplastic or elastomer to allow for a smooth and softer gripping surface than metal alone.

The plate 100 may be any size and weight. In the preferred embodiment the plate 100 is an Olympic size plate for use on an Olympic barbell. In other embodiments the plate 100 is a standard size plate for use with a standard barbell.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A weight lifting plate comprising a) a body having a first side, a second side, and a center of gravity;

b) a shaped central aperture disposed in said body, said shaped central aperture having a length and a width;

i) wherein said length is longer than said width;

ii) wherein said shaped central aperture has a substantially rectangular cross section;

c) one or more ball bearings disposed in said body and extending at least partially into said shaped central aperture; and d) wherein said center of gravity of said weight lifting plate is disposed within said shaped central aperture.

2. The weight lifting plate as in claim 1 a) wherein said one or more ball bearings further comprise i) one or more central ball bearings disposed in a position at a midpoint of said length of said shaped central aperture; and ii) one or more lateral ball bearings disposed between said midpoint of said length and an end of said length of said shaped central aperture.

3. The weight lifting plate as in claim 1 further comprising one or more recesses extending from said shaped central aperture.

4. The weight lifting plate as in claim 3 further comprising one or more springs respectively disposed in said one or more recesses.

5. The weight lifting plate as in claim 4 further comprising a) wherein said one or more recesses comprise a first recess and a second recess;

b) wherein said one or more springs comprise a first spring and a second spring;

c) wherein said one or more ball bearings comprise a first central ball bearing, a second central ball bearing, a first lateral ball bearing, a second lateral ball bearing, a third lateral ball bearing, and a fourth lateral ball bearing;

i) wherein said first central ball bearing and said second central ball bearing are respectively disposed at a midpoint of said length of said shaped central aperture;

ii) wherein said first lateral ball bearing, said second lateral ball bearing, said third lateral ball bearing, and said fourth lateral ball bearing are respectively disposed between said midpoint of said length and an end of said length of said shaped central aperture;

d) wherein said first spring is disposed in said first recess;

e) wherein said first central ball bearing is disposed in said first recess between said first spring and said shaped aperture;

f) wherein said second spring is disposed in said second recess;

g) wherein said second central ball bearing is disposed in said second recess between said second spring and said shaped aperture;

h) wherein said first recess and said second recess are disposed on opposite sides of said shaped aperture;

i) wherein said first lateral ball bearing and said second lateral ball bearing are disposed adjacent to said first central bearing, said first lateral ball bearing and said second lateral ball bearing being equidistant from said first lateral ball bearing; and j) wherein said third lateral ball bearing and said fourth lateral ball bearing are disposed adjacent to said second central bearing, said third lateral ball bearing and said fourth lateral ball bearing being equidistant from said second lateral ball bearing.

6. The weight lifting plate as in claim 1 further comprising one or more platforms disposed on an outer portion of said plate.

7. The weight lifting plate as in claim 6 wherein said one or more platforms comprise a first platform, a second platform, a third platform, and a fourth platform;

a) wherein said first platform and said second platform are disposed along said length of said shaped aperture on said first side of said body;

b) wherein said third platform and said fourth platform are disposed along said length of said shaped aperture on said second side of said body;

c) wherein said first platform and said second platform are disposed on opposite sides of said shaped aperture; and d) wherein said third platform and said fourth platform are disposed on opposite sides of said shaped aperture.

8. The weight lifting plate as in claim 1 further comprising one or more lateral protrusions.

9. The weight lifting plate as in claim 8 wherein said one or more lateral protrusions further comprises a) a first lateral protrusion, a second lateral protrusion, a third lateral protrusion, and a fourth lateral protrusion;

b) wherein said first lateral protrusion and said second lateral protrusion are disposed along said width of said shaped aperture on said first side of said body;

c) wherein said third lateral protrusion and said fourth lateral protrusion are disposed along said width of said shaped aperture on said second side of said body;

d) wherein said first lateral protrusion and said second lateral protrusion are disposed on opposite sides of said shaped aperture; and e) wherein said third lateral protrusion and said fourth lateral protrusion are disposed on opposite sides of said shaped aperture.

10. The weight lifting plate as in claim 8 further comprising one or more platforms disposed on an outer portion of said plate.

11. The weight lifting plate as in claim 9 further comprising one or more platforms disposed on an outer portion of said plate.

12. The weight lifting plate as in claim 11 wherein said one or more platforms comprise a first platform, a second platform, a third platform, and a fourth platform;

a) wherein said first platform and said second platform are disposed along said length of said shaped aperture on said first side of said body;

b) wherein said third platform and said fourth platform are disposed along said length of said shaped aperture on said second side of said body;

c) wherein said first platform and said second platform are disposed on opposite sides of said shaped aperture; and d) wherein said third platform and said fourth platform are disposed on opposite sides of said shaped aperture.

13. The weight lifting plate as in claim 12 further comprising one or more recesses extending from said shaped central aperture.

14. The weight lifting plate as in claim 13 further comprising one or more springs respectively disposed in said one or more recesses.

15. The weight lifting plate as in claim 14 further comprising a) wherein said one or more recesses comprise a first recess and a second recess;

b) wherein said one or more springs comprise a first spring and a second spring;

c) wherein said one or more ball bearings comprise a first central ball bearing, a second central ball bearing, a first lateral ball bearing, a second lateral ball bearing, a third lateral ball bearing, and a fourth lateral ball bearing;

i) wherein said first central ball bearing and said second central ball bearing are respectively disposed at a midpoint of said length of said shaped central aperture;

ii) wherein said first lateral ball bearing, said second lateral ball bearing, said third lateral ball bearing, and said fourth lateral ball bearing are respectively disposed between said midpoint of said length and an end of said length of said shaped central aperture;

d) wherein said first spring is disposed in said first recess;

e) wherein said first central ball bearing is disposed in said first recess between said first spring and said shaped aperture;

f) wherein said second spring is disposed in said second recess;

g) wherein said second central ball bearing is disposed in said second recess between said second spring and said shaped aperture;

h) wherein said first recess and said second recess are disposed on opposite sides of said shaped aperture;

i) wherein said first lateral ball bearing and said second lateral ball bearing are disposed adjacent to said first central bearing, said first lateral ball bearing and said second lateral ball bearing being equidistant from said first lateral ball bearing; and j) wherein said third lateral ball bearing and said fourth lateral ball bearing are disposed adjacent to said second central bearing, said third lateral ball bearing and said fourth lateral ball bearing being equidistant from said second lateral ball bearing.

16. The weight lifting plate as in claim 1 further comprising one or more apertures disposed in an outer portion of said plate.

17. The weight lifting plate as in claim 1 further comprising a cap disposed within said shaped aperture, wherein said cap is disposed adjacent to said one or more ball bearings, wherein said cap retains said one or more ball bearings in said body.

18. The weight lifting plate as in claim 1 further comprising an outer rim disposed along a circumference of said body.

19. A method of exercising comprising a) obtaining a weight lifting plate, wherein said weight lifting plate comprises i) a body having a first side and a second side;

ii) a shaped central aperture disposed in said body, said shaped central aperture having a length and a width;

(1) wherein said length is longer than said width;

(2) wherein said shaped central aperture has a substantially rectangular cross section;

iii) one or more ball bearings disposed in said body and extending at least partially into said shaped central aperture;

iv) wherein a center of gravity of said weight lifting plate is disposed within said shaped central aperture;

b) simultaneously placing four fingers through said shaped central aperture along said length;

c) ensuring that each of said four fingers is disposed adjacent to at least one of said one or more ball bearings; and d) moving said weight lifting plate.

20. The method of exercising as in claim 19 a) wherein said weight lifting plate further comprises i) a lateral protrusion disposed along said width of said shaped central aperture;

ii) a platform disposed along said length of said shaped central aperture;

b) wherein said method further comprises i) placing a thumb against said lateral protrusion; and ii) placing a palm against said platform.

* * * * *